US009214327B2

(12) United States Patent
Nakano

(10) Patent No.: US 9,214,327 B2
(45) Date of Patent: Dec. 15, 2015

(54) VACUUM ANALYZER UTILIZING RESISTANCE TUBES TO CONTROL THE FLOW RATE THROUGH A VACUUM REACTION CHAMBER

(75) Inventor: Tomohito Nakano, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 13/813,875

(22) PCT Filed: Jul. 19, 2011

(86) PCT No.: PCT/JP2011/066299

§ 371 (c)(1),
(2), (4) Date: Feb. 1, 2013

(87) PCT Pub. No.: WO2012/017812

PCT Pub. Date: Feb. 9, 2012

(65) Prior Publication Data

US 2013/0134306 A1 May 30, 2013

(30) Foreign Application Priority Data

Aug. 5, 2010 (JP) ..... 2010-175904

(51) Int. Cl.
*H01J 49/24* (2006.01)
*H01J 49/16* (2006.01)
(Continued)

(52) U.S. Cl.
CPC ..... *H01J 49/24* (2013.01); *H01J 49/005* (2013.01)

(58) Field of Classification Search
USPC ..... 250/281
See application file for complete search history.

(56) References Cited

U.S. PATENT DOCUMENTS 6,338,823 B1 * 1/2002 Furukawa ..... 422/89
6,833,028 B1 * 12/2004 Scheer et al. ..... 118/309
(Continued)

FOREIGN PATENT DOCUMENTS

JP 2009-174994 A 8/2009

OTHER PUBLICATIONS

The effect of oxygen-containing reagents on the crystal morphology and orientation in tungsten oxide thin films deposited via atmospheric pressure chemical vapour deposition (APCVD) on glass substrates Geoffrey Hyett, Christopher S. Blackman and Ivan P. Parkin.*
(Continued)

*Primary Examiner* — Nicole Ippolito
*Assistant Examiner* — Sean Luck
(74) *Attorney, Agent, or Firm* — Sughrue Mion, PLLC

(57) ABSTRACT

A vacuum analyzer including a vacuum reaction chamber; a gas source; a flow rate-restricting resistance tube connected to the reaction chamber; a pressure detection device disposed upstream from the flow rate-restricting resistance tube; a flow rate adjustment for adjusting the amount of gas exiting the flow rate-restricting resistance tube so that the detected value from the pressure detection device reaches a prescribed value; a split flow path that is provided with a splitter resistance tube and divides the gas at a location between the flow rate adjustment and the pressure detection device; a passage open to the atmosphere which divides the gas flowing from upstream at a location between the flow rate adjustment and the pressure detection device and releases the divided gas to the atmosphere; and a valve provided in the passage open to the atmosphere. Therein, the split flow path is connected immediately downstream from the valve.

7 Claims, 4 Drawing Sheets

(51) Int. Cl.
*H01J 49/26* (2006.01)
*H01J 49/00* (2006.01)

(56) References Cited

U.S. PATENT DOCUMENTS

| | | | | |
|---|---|---|---|---|
| 7,140,847 | B2 * | 11/2006 | Boger et al. | 417/296 |
| 7,332,714 | B2 * | 2/2008 | Watanabe et al. | 250/283 |
| 2002/0048818 | A1 * | 4/2002 | Sakairi et al. | 436/126 |
| 2003/0094136 | A1 * | 5/2003 | Bartholomew et al. | 118/715 |
| 2005/0086997 | A1 * | 4/2005 | Arii et al. | 73/25.01 |
| 2009/0071327 | A1 * | 3/2009 | Latham et al. | 95/22 |
| 2009/0090174 | A1 * | 4/2009 | Paul et al. | 73/61.56 |
| 2009/0189073 | A1 | 7/2009 | Yamaguchi | |
| 2010/0058984 | A1 * | 3/2010 | Marubayashi et al. | 118/715 |

OTHER PUBLICATIONS

International Search Report of PCT/JP2011/066299 dated Jan. 17, 2012.

* cited by examiner

VACUUM ANALYZER UTILIZING RESISTANCE TUBES TO CONTROL THE FLOW RATE THROUGH A VACUUM REACTION CHAMBER

CROSS REFERENCE TO RELATED APPLICATIONS

This application is a National Stage of International Application No. PCT/JP2011/066299 filed Jul. 19, 2011, claiming priority based on Japanese Patent Application No. 2010-175904 filed Aug. 5, 2010, the contents of all of which are incorporated herein by reference in their entirety.

TECHNICAL FIELD

The present invention relates to a vacuum analyzer; more specifically, the present invention relates to a collision-induced dissociation chamber used in an MS/MS analytical method.

BACKGROUND ART

Figure 1:
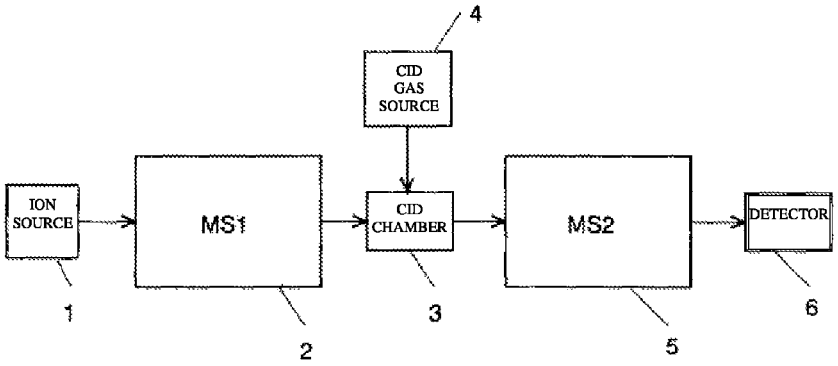
FIG. 1 Prior Art

FIG. 1 shows a summary of a typical MS/MS analytical method using collision-induced dissociation (CID). A first mass spectrograph (MS1) 2 selects precursor ions from among ions arriving from an ion source 1. The selected precursor ions are carried to a collision-induced dissociation chamber (CID chamber) 3, where the ions collide with a CID gas introduced from a CID gas source 4 within the CID chamber 3 and dissociate to form fragment ions. The generated fragment ions are carried to a second mass spectrograph (MS2) 5 and are detected by a detector 6. As a result, it is possible to obtain a spectrum with structural information (Patent Literature 1).

Figure 2:
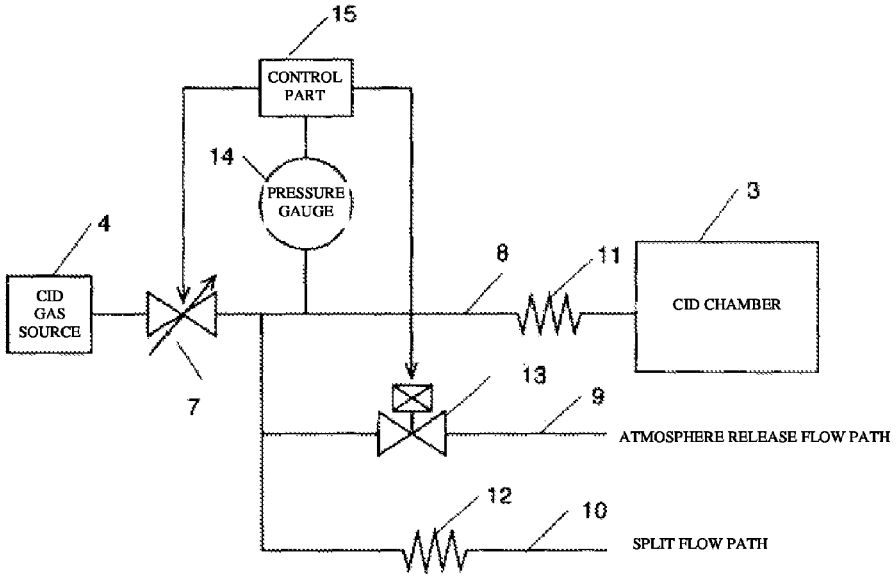
FIG. 2 Prior Art

FIG. 2 is a block diagram of a flow paths used to control the flow rate of the gas introduced into the CID chamber 3. The CID chamber 3 is maintained at a medium vacuum or a high vacuum by a vacuum pump not shown in the drawing. A control valve 7 is installed immediately downstream from the CID gas source 4, and the flow path is divided into three flow paths—a main flow path 8 leading to the CID chamber 3, an atmosphere release flow path 9, and a split flow path 10—downstream from the control valve 7. A flow rate restricting resistance tube 11 and a split resistance tube 12 are disposed on the main flow path 8 and the split flow path 10, respectively, and an atmosphere release valve 13 is provided on the atmosphere release flow path 9. A pressure gauge 14 is installed upstream from the flow rate restricting resistance tube 11 of the main flow path 8. A control part 15 adjusts the degree of opening of the control valve 13 so that the gas pressure measured by the pressure gauge 14 reaches a prescribed value. The volumetric flow rate of the gas per unit time flowing into the CID chamber 3 in the standard state (20° C., atmospheric pressure) is proportional to the square of the gas pressure upstream from the flow rate restricting resistance tube 11 of the main flow path 8, so the flow rate of gas flowing into the CID chamber 3 can be controlled by adjusting the degree of opening of the control valve 13.

The CID gas is introduced into the CID chamber 3 from the CID gas source 4 through the main flow path 8, but the flow rate is extremely low (for example, approximately 0.1 cc/min in the standard state). Therefore, in the block diagram of the flow paths shown in FIG. 2, the CID gas is constantly discharged from the split flow path 10, and the volume of gas flowing into the main flow path 8 is reduced as a result. With such a configuration, the rate of change of the flow rate per unit time in the main flow path 8 is suppressed, which facilitates the control of the flow rate within a minute range.

Since the respective resistance tubes 11 and 12 are disposed on the main flow path 8 and the split flow path 10, the gas pressure on the downstream side of the resistance tubes 11 and 12 is lower than the gas pressure on the upstream side. By appropriately setting the inside diameters and lengths of the respective resistance tubes 11 and 12, it is possible to introduce a gas of a desired flow rate into the CID chamber 3. In order to control the gas flow rate into the CID chamber 3 to such a minute level after regulating the pressure of the gas discharged from the CID gas source 4 to at least atmospheric pressure (for example, approximately 300 kpa to 500 kpa), it is necessary to set the resistances of the resistance tubes 11 and 12 to extremely high levels.

In such a flow path configuration, even if the degree of opening of the control valve 7 is narrowed in order to reduce the flow rate of gas flowing into the CID chamber 3, the gas pressure upstream from the resistance tubes 11 and 12 will be reluctant to decrease. Therefore, the control part 15 releases the high-pressure gas upstream from the resistance tubes 11 and 12 via the atmosphere release flow path 9 by opening the atmosphere release valve 13 while simultaneously narrowing the degree of opening of the control valve 7. This makes it possible to instantaneously reduce the gas pressure upstream from the resistance tubes 11 and 12 and, as a result, it is possible to reduce the flow rate of gas flowing into the CID chamber 3 to a desired level in a short amount of time.

PRIOR ART LITERATURES

Patent Literatures

Patent Literature 1: Japanese Unexamined Patent Application Publication 2009-174994

SUMMARY OF THE INVENTION

Problem to be Solved by the Invention

However, before the atmosphere release valve 13 is opened, the flow path on the upstream side of the atmosphere release valve 13 is filled with the CID gas, and the flow path on the downstream side is filled with atmospheric gas. That is, differences in the concentrations of the CID gas and the atmospheric gas arise between the upstream side and the downstream side of the atmosphere release valve 13. When the atmosphere release valve 13 is opened in such a state, the atmosphere present outside the end of the atmosphere release flow path 9 becomes immixed from the end due to the diffusion effect. When this state is left alone, there is a risk that the atmospheric gas may ultimately flow into the CID chamber 3 and cause the efficiency of collision-induced dissociation to decrease.

The present invention was conceived in light of the problem described above, and the object of the present invention is to provide a vacuum analyzer with such a configuration in which atmospheric gas is prevented from becoming immixed inside a reaction chamber from the end of an atmosphere release flow path due to the diffusion effect.

Means for Solving the Problem

The vacuum analyzer of a first aspect of the present invention conceived in order to solve the problem described above is a vacuum analyzer comprising:

a) a vacuum reaction chamber;

b) a gas source for supplying a gas into the vacuum reaction chamber;

c) a flow rate restricting resistance tube, the outlet end of which is connected to the vacuum reaction chamber;

d) a pressure detection means disposed upstream from the flow rate restricting resistance tube;

e) a flow rate adjustment means which is disposed between the pressure detection means and the gas source and adjusts the flow rate of gas flowing out of the flow rate restricting resistance tube so that the detected value from the pressure detection means reaches a prescribed value;

f) a split flow path which divides the gas flowing from the upstream between the flow rate adjustment means and the pressure detection means and is provided with a split resistance tube;

g) an atmosphere release path which divides the gas flowing from the upstream between the flow rate adjustment means and the pressure detection means and releases the divided gas into the atmosphere; and h) a valve provided in the atmosphere release path;

wherein the split flow path is connected immediately downstream from the valve of the atmosphere release path.

The vacuum analyzer of a second aspect of the present invention conceived in order to solve the problem described above is a vacuum analyzer comprising:

a) a vacuum reaction chamber;

b) a gas source for supplying a gas into the vacuum reaction chamber;

c) a flow rate restricting resistance tube, the outlet end of which is connected to the vacuum reaction chamber;

d) a pressure detection means disposed upstream from the flow rate restricting resistance tube;

e) a flow rate adjustment means which is disposed between the pressure detection means and the gas source and adjusts the flow rate of gas flowing out of the flow rate restricting resistance tube so that the detected value from the pressure detection means reaches a prescribed value;

f) a split flow path which divides the gas flowing from the upstream between the flow rate adjustment means and the pressure detection means and is provided with a split resistance tube;

g) an atmosphere release path which divides the gas flowing from the upstream between the flow rate adjustment means and the pressure detection means and releases the divided gas into the atmosphere;

h) a valve provided in the atmosphere release path; and i) a bypass flow path which divides the gas from the gas source upstream from the flow rate adjustment means;

wherein the bypass flow path is connected immediately downstream from the valve of the atmosphere release path.

The vacuum analyzer of a third aspect of the present invention conceived in order to solve the problem described above is a vacuum analyzer according to the first or second aspect, wherein:

the vacuum reaction chamber is a collision chamber for collision-induced dissociation; and the gas is a gas used for collision-induced dissociation.

Effect of the Invention

In the vacuum analyzer of the present invention, the split flow path or the bypass flow path is connected immediately downstream from the valve provided on the atmosphere release path (hereinafter called an atmosphere release valve), so the gas from the gas source can be constantly fed directly to the downstream of the atmosphere release valve via the split flow path or the bypass flow path. The gas flowing directly to the downstream of the atmosphere release valve continues to flow toward the end side of the atmosphere release path. As a result, the gas concentration is equalized between the end side of the atmosphere release path and the part immediately downstream from the atmosphere release valve. In addition, when the atmosphere release valve is opened, the gas from the gas source flows into the atmosphere release path via the atmosphere release valve. As a result, the gas concentration is also equalized between the upstream part and the downstream part of the atmosphere release valve. If there is a difference between the gas concentrations on the end side of the atmosphere release part, the part directly downstream from the atmosphere release valve, and the upstream side of the atmosphere release valve, the atmosphere present outside the atmosphere release part will become immixed from the end due to diffusion. However, in the vacuum analyzer of the present invention, no differences arise in the gas concentrations within the atmosphere release part, so it is possible to prevent the atmospheric gas from becoming immixed upstream from the atmosphere release valve due to diffusion.

BRIEF DESCRIPTION OF THE DRAWINGS (FIG. 1) is a schematic representation of a typical MS/MS method using collision-induced dissociation.

(FIG. 2) is a block diagram of conventional flow paths for introducing a CID gas into a CID chamber.

(FIG. 3) is a block diagram of the flow paths of the present invention for introducing a CID gas into a CID chamber.

(FIG. 4) is a block diagram of the flow paths of an example of variation of the present invention for introducing a CID gas into a CID chamber.

MODES FOR CARRYING OUT THE INVENTION

Embodiments of the present invention will be described with reference to FIG. 3.

Embodiments

The block diagram of an entire mass spectroscope for performing MS/MS analysis as an embodiment of the vacuum analyzer of the present invention is the same as the conventional block diagram shown in FIG. 1. Various mass spectrographs such as a quadrupole mass spectrograph, an end cap spectrograph, or a time-of-flight mass spectrograph can be used as the first and second mass spectrographs 2 and 4 in FIG. 1.

Figure 3:
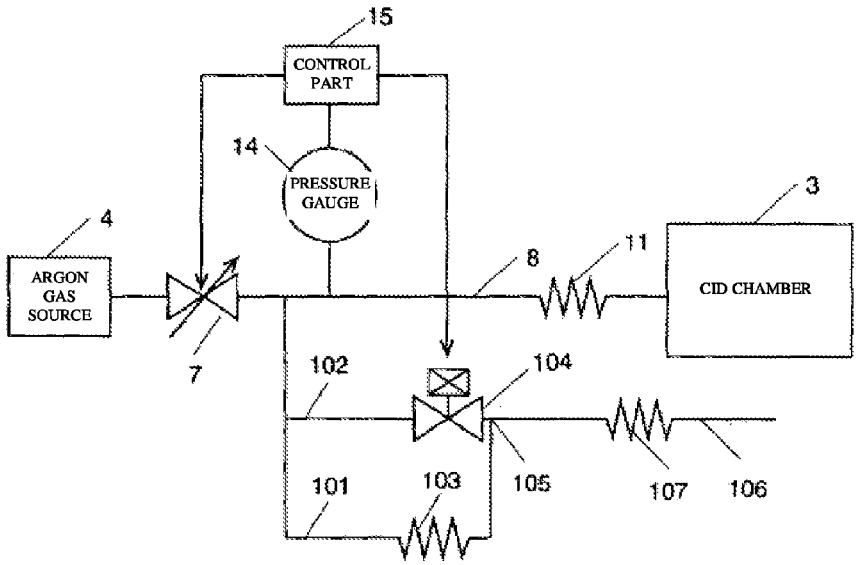

FIG. 3 shows a block diagram of the flow paths of this embodiment for supplying a CID gas to a CID chamber 3. In this embodiment, a pure argon gas is used as the CID gas. A control valve 7 is installed immediately downstream from an argon gas source 4, and the flow path is divided into three flow paths—a main flow path 8 leading to the CID chamber 3, a split flow path 101, and an atmosphere release flow path 102—downstream from the control valve 7. A split resistance tube 103 is installed on the split flow path 101, and an atmosphere release valve 104 is provided on the atmosphere release flow path 102. The split flow path 101 and the atmosphere release flow path 102 converge once again immediately downstream from the atmosphere release valve 104 (convergence point 105) to form a gas purging flow path 106. A resistance tube (gas purging resistance tube 107, inside diameter: 1.6 mm, length: 200 mm) is also installed on the gas purging flow path 106. The resistance of the gas purging resistance tube 107 is significantly smaller than that of the flow rate restricting resistance tube 11 (inside diameter: 40 μm, length: 600 mm) or the split resistance tube 103 (inside diameter: 40 μm, length: 25 mm). The main flow path 8, the flow rate restricting resistance tube 11, the pressure gauge 14, and the control part 15 are the same as those described in the conventional flow path block diagram shown in FIG. 2.

In the flow path block diagram shown in FIG. 3, the operation of a case in which argon gas is fed into the CID chamber 3 at 0.15 cc/min (sccm) and the flow rate is then changed to 0.1 cc/min (sccm) will be described.

First, the gas inside the CID chamber 3 is discharged by a vacuum pump not shown in the drawing so as to maintain a high vacuum inside the CID chamber 3. At this time, the control valve 7 and the atmosphere release valve 104 are closed.

In order to set the flow rate of gas into the CID chamber 3 to 0.15 cc/min in the flow path configuration of this embodiment, it is necessary to maintain a pressure of 230 kPa in the main flow path 8, so the control part 15 adjusts the degree of opening of the control valve 7 so that the pressure gauge 14 indicates 230 kPa. The pure argon gas of the argon gas source 4 flows into the main flow path 8 and the split flow path 101. The argon gas flow rate in the split flow path 101 is 6 cc/min. The flow rate restricting resistance tube 11 and the split resistance tube 103 are respectively disposed on the main flow path 8 and the split flow path 101, and the argon gas passing through the respective resistance tubes decreases in pressure downstream from the tubes. The argon gas passing through the split resistance tube 103 flows into the gas purging flow path 106 via the part 105 directly downstream from the atmosphere release valve 104. Since the end of the gas purging flow path 106 is opened to the atmosphere, the argon gas flowing into the gas purging flow path 106 constantly continues to be discharged into the atmosphere.

Next, the flow rate of the argon gas into the CID chamber 3 is changed to 0.1 cc/min. In order to set the flow rate of the gas into the CID chamber 3 to 0.1 cc/min in the flow path configuration of this embodiment, it is necessary to change the pressure in the main flow path 8 to 180 kPa. The control part 15 adjusts the degree of opening of the control valve 7 so that the pressure gauge 14 indicates 180 kPa. At this time, the argon gas flow rate in the split flow path 101 is 4.7 cc/min. When the control part 15 then opens the atmosphere release valve 104, the high-pressure gas retained upstream from the resistance tubes 11 and 103 flows into the gas purging flow path 106 via the atmosphere release valve 104 and is discharged from the end. This is because although the gas purging resistance tube 107 is disposed on the gas purging flow path 106, the resistance is significantly lower than that of the flow rate restricting resistance tube 11 or the split resistance tube 103. As a result, it is possible to reduce the gas pressure downstream from the flow rate restricting resistance tube 11 or the split resistance tube 103 in a short amount of time.

As described above, in the flow path block diagram of this embodiment, the argon gas constantly continues to be discharged into the atmosphere from the gas purging flow path 106. That is, the argon gas constantly flows from the split flow path 101 into the part 105 immediately downstream from the atmosphere release valve 104 and continues to flow toward the end of the gas purging flow path 106 , so the argon gas concentration is equalized within the gas purging flow path 106. In addition, immediately after the atmosphere release valve 104 is opened, the high-pressure gas upstream from the resistance tubes 11 and 103 passes through the atmosphere release flow path 102 and into the gas purging flow path 106 via the atmosphere release valve 104, but after a certain amount of time has passed, the gas from the argon gas source 4 is divided into the main flow path 8, the split flow path 101, and the atmosphere release flow path 102 and continues to flow. Accordingly, the concentrations of argon gas in the atmosphere release flow path 102 and the gas purging flow path 106 are equalized, so the atmosphere is never immixed on the upstream side of the atmosphere release valve 104 from the downstream side of the gas purging flow path due to the diffusion effect, even if the atmosphere release valve 104 is opened.

Figure 4:
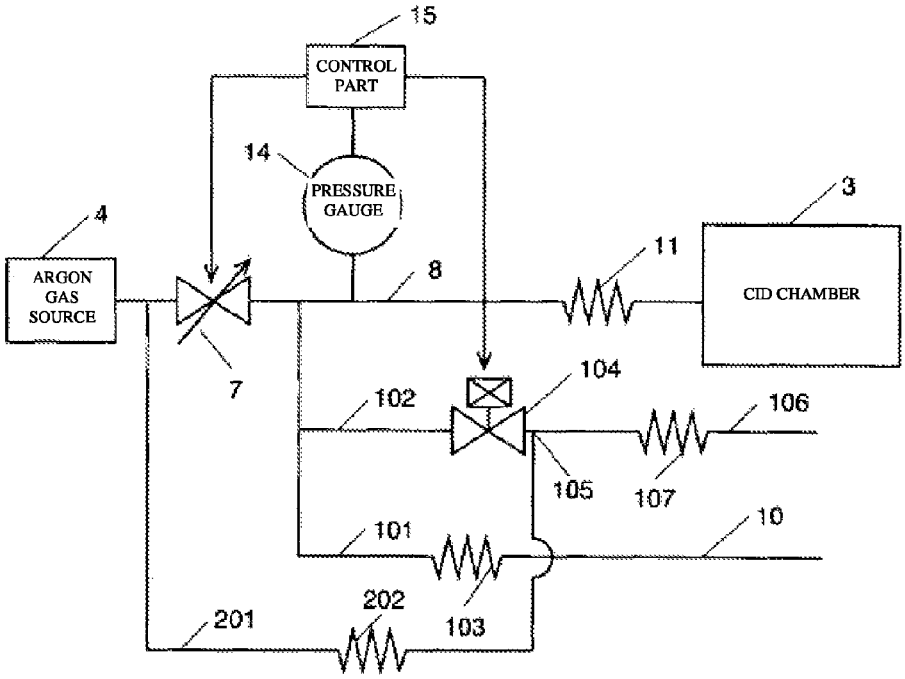

The flow path block diagram of an example of variation of this embodiment is shown in FIG. 4. In this example of variation, a bypass flow path 201 is divided from the upstream of the control valve 7 and converges with the atmosphere release flow path 102 at the part 105 immediately downstream from the atmosphere release valve 104 to form the gas purging flow path 106. A bypass resistance tube 202 is disposed on this bypass flow path 201. The resistance of the bypass resistance tube 202 should be set to a level significantly higher than the resistance of the gas purging resistance tube 107. For example, a tube with an inside diameter of 40 μm and a length of 300 mm, for example, should be used. The split flow path 101 does not converge with the atmosphere release flow path 102 and is provided with the split resistance tube 103, the end of which is opened to the atmosphere.

In the flow path block diagram of this example of variation, the argon gas flow divided from the argon gas source 4 to the bypass flow path 201 is connected to the part 105 immediately downstream from the atmosphere release valve 104 so that the argon gas is constantly discharged into the atmosphere from the gas purging flow path 106. Even in cases in which the degree of opening of the control valve 7 is narrowed and the atmosphere release valve is opened in order to reduce the flow rate of the argon gas, the argon gas continues to flow into the atmosphere release flow path 102 and the gas purging flow path 106. Accordingly, as in the embodiment described above, there is no difference in the concentrations of argon gas between the upstream part and the downstream part of the atmosphere release valve 104, and the atmosphere is never immixed on the upstream side of the atmosphere release valve 104 from the end of the gas purging flow path 106. The present invention is not limited to the embodiments described above, and modifications are permissible within the scope of the gist of the invention.

EXPLANATION OF REFERENCES

1 . . . ion source
2 . . . first mass spectrograph
3 . . . collision-induced dissociation (CID) chamber
4 . . . CID gas source
5 . . . second mass spectrograph
6 . . . detector
7 . . . control valve
8 . . . main flow path
9, 102 . . . atmosphere release flow paths
10, 101 . . . split flow paths
11 . . . flow path restricting resistance tube
12, 103 . . . split resistance tubes
13, 104 . . . atmosphere release valves
14 . . . pressure gauge
15 . . . control part
105 . . . conversion point
106 . . . gas purging flow path
107 . . . gas purging resistance tube
201 . . . bypass flow path
202 . . . bypass flow path resistance tube.

The invention claimed is:

1. A vacuum analyzer comprising: a) a vacuum reaction chamber; wherein the vacuum reaction chamber is a collision chamber for collision-induced dissociation configured to be used in a mass analysis system; b) a gas source for supplying a gas into said vacuum reaction chamber; c) a flow rate restricting resistance tube, the outlet end of which is connected to said vacuum reaction chamber; d) a pressure detection means disposed upstream from said flow rate restricting resistance tube; e) a flow rate adjustment means which is disposed between said pressure detection means and said gas source and adjusts the flow rate of gas flowing out of said flow rate restricting resistance tube so that the detected value from said pressure detection means reaches a prescribed value; f) a split flow path which divides the gas flowing from the upstream between said flow rate adjustment means and said pressure detection means and is provided with a split resistance tube; g) an atmosphere release path which divides the gas flowing from the upstream between said flow rate adjustment means and said pressure detection means and releases the divided gas into the atmosphere; and h) a valve provided in said atmosphere release path;

wherein said split flow path is connected immediately downstream from said valve of said atmosphere release path; a gas purging resistance tube is provided downstream from where said split flow path connects to said atmosphere release path; and a resistance to gas flow at least atmospheric pressure due to a length and an inside diameter of said gas purging resistance tube is smaller than a resistance to gas flow at least atmospheric pressure due to a length and an inside diameter of said flow rate restricting resistance tube, and is smaller than a resistance to gas flow at least atmospheric pressure due to a length and an inside diameter of said split resistance tube, such that a flow rate of gas through said split flow path is at least an order of magnitude greater than a flow rate of gas into said vacuum reaction chamber.

2. A vacuum analyzer comprising: a) a vacuum reaction chamber; wherein the vacuum reaction chamber is a collision chamber for collision-induced dissociation configured to be used in a mass analysis system; b) a gas source for supplying a gas into said vacuum reaction chamber; c) a flow rate restricting resistance tube, the outlet end of which is connected to said vacuum reaction chamber; d) a pressure detection means disposed upstream from said flow rate restricting resistance tube; e) a flow rate adjustment means which is disposed between said pressure detection means and said gas source and adjusts the flow rate of gas flowing out of said flow rate restricting resistance tube so that the detected value from said pressure detection means reaches a prescribed value; f) a split flow path which divides the gas flowing from the upstream between said flow rate adjustment means and said pressure detection means and is provided with a split resistance tube; g) an atmosphere release path which divides the gas flowing from the upstream between said flow rate adjustment means and said pressure detection means and releases the divided gas into the atmosphere; h) a valve provided in said atmosphere release path; and i) a bypass flow path which divides the gas from said gas source upstream from said flow rate adjustment means and is provided with a bypass resistance tube; wherein said bypass flow path is connected immediately downstream from said valve of said atmosphere release path; a gas purging resistance tube is provided downstream from where said split flow path connects to said atmosphere release path; and a resistance to gas flow at at least atmospheric pressure due to a length and an inside diameter of said bypass resistance tube is higher than a resistance to gas flow at least atmospheric pressure due to a length and an inside diameter of said gas purging resistance tube: such that a flow rate of gas through said split flow path is at least an order of magnitude greater than a flow rate of gas into said vacuum reaction chamber.

3. The vacuum analyzer according to claim 1, wherein: said gas is a gas used for collision-induced dissociation.

4. The vacuum analyzer according to claim 1, wherein the inside diameter of said gas purging resistance tube is greater than or equal to 1.6 mm;

the inside diameter of said flow rate restricting resistance tube is less than or equal to 40 μm; and the inside diameter of said split resistance tube is less than or equal to 40 μm.

5. The vacuum analyzer according to claim 4, wherein:

the length of said gas purging resistance tube is less than or equal to 200 mm;

the length of said flow rate restricting resistance tube is greater than or equal to 600 mm; and the length of said split resistance tube is greater than or equal to 25 mm.

6. The vacuum analyzer according to claim 2, wherein the inside diameter of said gas purging resistance tube is greater than or equal to 1.6 mm;

the inside diameter of said bypass resistance tube is less than or equal to 40 μm.

7. The vacuum analyzer according to claim 6, wherein:

the length of said gas purging resistance tube is less than or equal to 200 mm;

the length of said bypass resistance tube is greater than or equal to 300 mm.

* * * * *